United States Patent [19]

Hill

[11] Patent Number: 4,599,949

[45] Date of Patent: Jul. 15, 1986

[54] LIGHT WEIGHT CONTAINER CAR

[75] Inventor: Charles C. Hill, Del Mar, Calif.

[73] Assignee: Gunderson, Inc., Portland, Oreg.

[21] Appl. No.: 704,435

[22] Filed: Feb. 25, 1985

[51] Int. Cl.[4] ..... B61D 3/20; B61F 1/08

[52] U.S. Cl. ..... 105/355; 105/238 R; 105/418; 280/797

[58] Field of Search ..... 105/200, 226, 228, 238 R, 105/355, 413, 414, 418–420; 296/203–205, 209; 280/781, 796–798; 52/731

[56] References Cited

U.S. PATENT DOCUMENTS

| | | | |
|---|---|---|---|
| 2,194,356 | 3/1940 | Eklund | 280/797 |
| 2,327,585 | 8/1943 | Ulrich | 280/797 X |
| 2,504,112 | 4/1950 | Dean et al. | 105/414 |
| 3,520,256 | 7/1970 | Gutridge | 410/52 |
| 3,659,724 | 5/1972 | Miller et al. | 105/418 X |
| 4,064,947 | 12/1977 | Cole | 52/731 X |
| 4,091,742 | 5/1978 | Cordani | 105/418 X |

FOREIGN PATENT DOCUMENTS

| | | | |
|---|---|---|---|
| 629980 | 12/1961 | Italy | 52/731 |

*Primary Examiner*—Randolph A. Reese

*Attorney, Agent, or Firm*—Chernoff, Vilhauer, McClung & Stenzel

[57] ABSTRACT

Improvements in the body of a light weight railway car is disclosed with one improved portion being a side sill formed from a metal plate having a plurality of short tubes welded thereto and projecting outwardly therefrom. A channel is welded to the plate and has a plurality of holes formed therein which are aligned with the tubes, with the metal removed to form the holes being substantially equal in weight to that of the tubes. The tubes are welded to the channel near the periphery of the holes. The side sills cooperate with body bolsters and container engaging feet for handling a double tier of a variety of different size containers.

5 Claims, 8 Drawing Figures

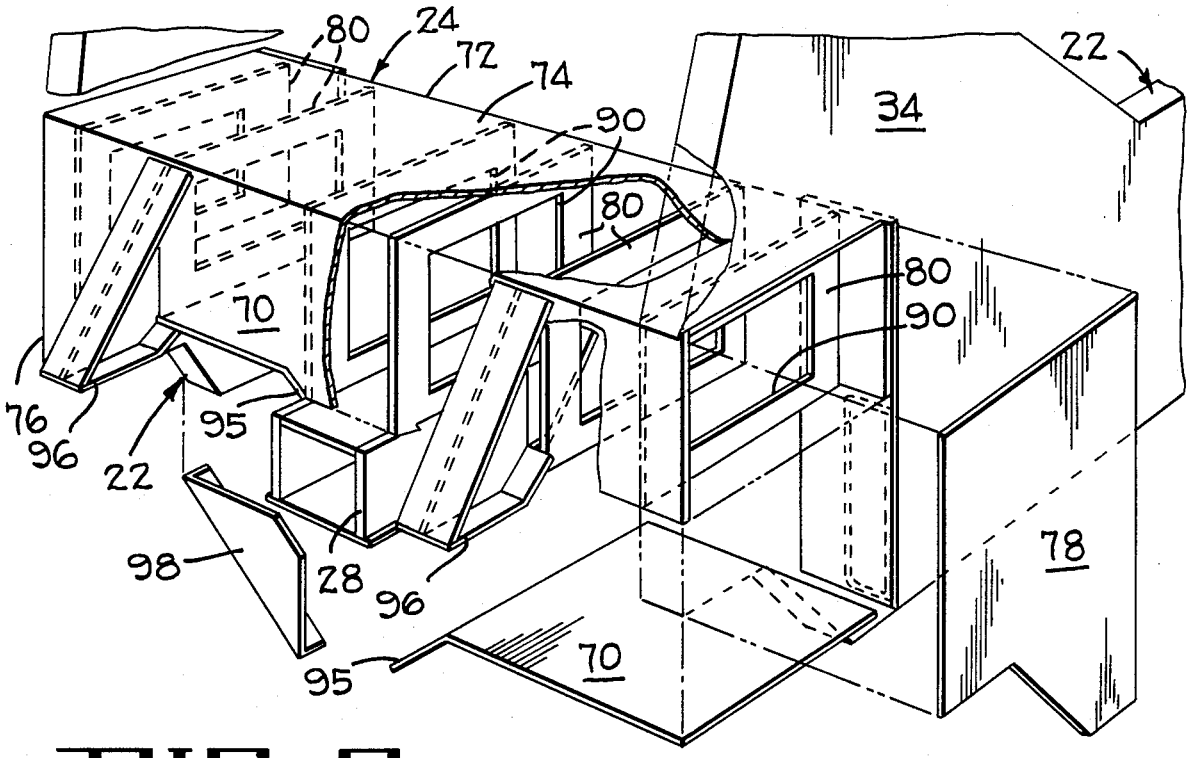
FIG_6
FIG_8
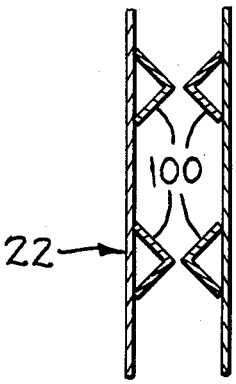
FIG_7
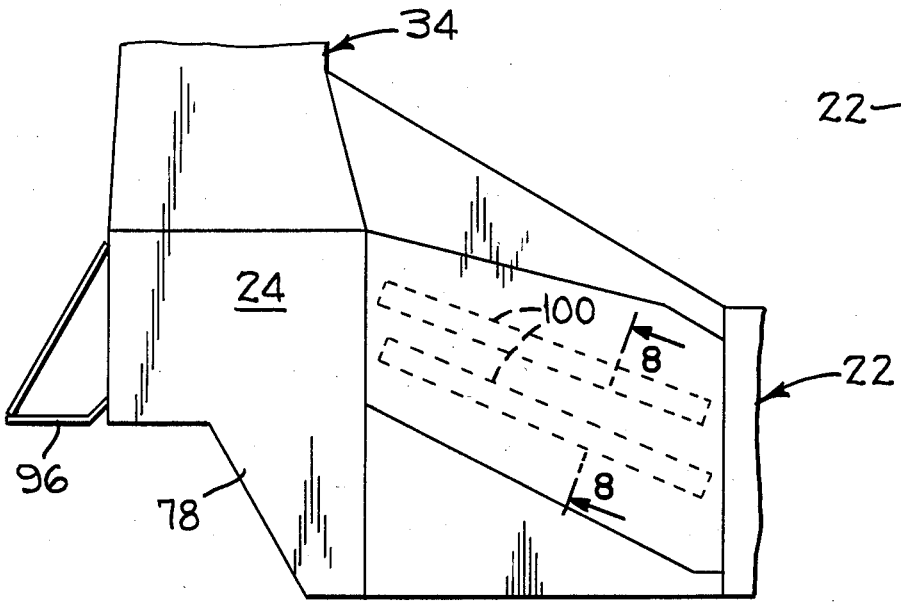

LIGHT WEIGHT CONTAINER CAR

CROSS REFERENCE TO RELATED APPLICATIONS

The present invention is related to the invention disclosed in Kaleta application Ser. No. 640,733 which was filed on Aug. 14, 1984 and is entitled Stack Supporting Container Car. The Kaleta application is assigned to the assignee of the present invention and is incorporated by reference herein.

BACKGROUND OF THE INVENTION

Field of the Invention

The present invention relates to light weight railway cars and more particularly relates to such cars having side sills and body bolsters which are light in weight with the side sills reinforced to minimize local buckling.

SUMMARY OF THE PRESENT INVENTION

In accordance with the present invention light weight but strong side sills are each formed from a relatively thin metal outer plate which is welded to an inner channel that is provided with a plurality of spaced apertures along its length. A plurality of short transversely extending strengthening rings or tubes are welded to the outer plate and to the peripheries of the apertures in the channel to provide a rigid box beam side sill that prevents localized warping and buckling during normal operation. The weight of material removed from the channel to form the openings is substantially equal to the weight of the tubes thus minimizing the overall weight of the car. The side sills are rigidly secured to body bolsters which are fabricated as box beams to further reduce the weight of the car. The car is provided with container supporting feet secured to the lower portion of the side sills for supporting either two 20 foot or one 40 foot long container in a lower tier; and either a 40 foot or 45 foot container in an upper tier. The car may support a stack of containers having a total height of about 19 feet, and a width of either about 8 feet or 8½ feet.

BRIEF DESCRIPTION OF THE DRAWINGS

FIG. 6 is a partially exploded perspective of one of the body bolsters shown connected to the side sills.

FIG. 7 is a fragment of one end of a side sill illustrating the side sill connected to a body bolster.

FIG. 8 is a section taken along lines 8—8 of FIG. 7 illustrating V-shaped stiffening members.

DESCRIPTION OF THE PREFERRED EMBODIMENT

Figure 1:
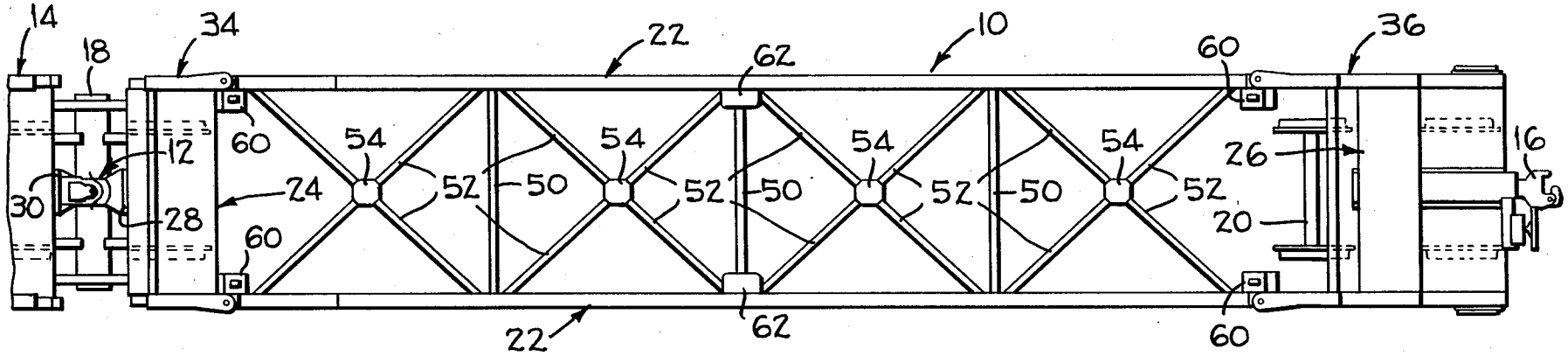
FIG. 1 is a plan of one end car having a standard coupler on one end and an articulating coupler on the other end shown coupled to a fragment of an intermediate car.

The light weight container car 10 (FIGS. 1–3) of the present invention is similar to that disclosed in the aforementioned Kaleta application. Accordingly, components of the car 10 which are similar to those of the Kaleta car will not be described in detail and if a more detailed description is desired of these components, reference may be had to the cross-referenced Kaleta application.

In general, a plurality of cars (or car units), preferably five cars, are connected together by articulating joints 12 that pivotally connect intermediate cars 14 (only one being shown) to other intermediate cars and to two end cars 10 (only one being shown) which have standard railway couplers 16 thereon for connection to standard railway cars or to a railway engine (not shown). It will be noted that the adjacent ends of each pair of cars that are coupled together by an articulating joint 12 are both pivotally supported on a common four wheel truck such as truck 18; while the other end of each end car 10 (only one being shown) is supported by only one truck 20.

Each end car 10 includes a pair of side sills 22 which are rigidly connected to body bolsters 24, 26. The body bolster 24 is connected to a stub center sill 28 rigidly secured to one-half of the associated articulating joint 12 while a similar stub-center sill 30 is rigidly secured to the next adjacent intermediate car, such as car 14. Similarly, the body bolster 26 is rigidly connected to a stub-center sill 32 which is, in turn, rigidly connected to the coupler 16. The body bolster 24 is pivotally connected to the associated trucks 18 by the articulating joint 12 by conventional means (not shown). The body bolster 26 is likewise pivotally connected to the truck 20 by conventional means (not shown).

End bulkheads 34, 36 are welded to the adjacent ends of the side sills 22 and to the adjacent body bolsters 24, 26 respectively. It will be noted that the end bulkhead 36 is slightly longer than the bulkhead 34 to accommodate the slightly longer side sills 22 that are required on the end cars, such as car 10, due to the need of the four wheel truck 20 and standard coupling 16 for connection to other standard railway cars. It will be understood that all intermediate cars have short bulkheads 34 on both ends of the side sills of the associated cars, and that the side sills are formed with both ends the same as the bulkhead 34 of car 10.

Figure 4:
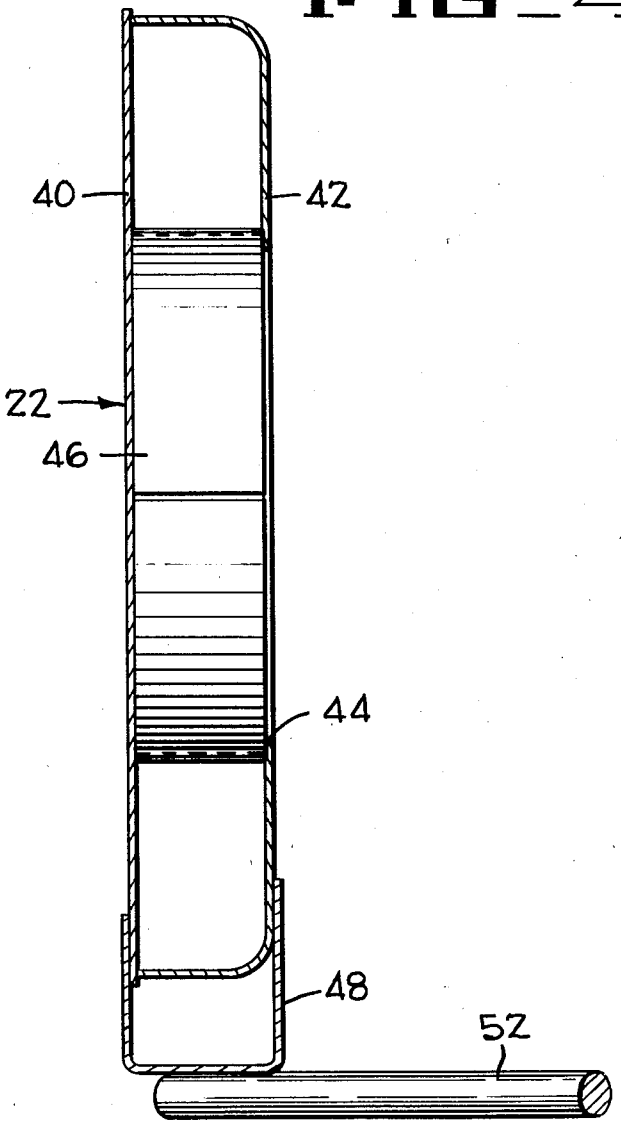
FIG. 4 is a transverse section taken along lines 4—4 of FIG. 2 through one of the side sills.
Figure 5:
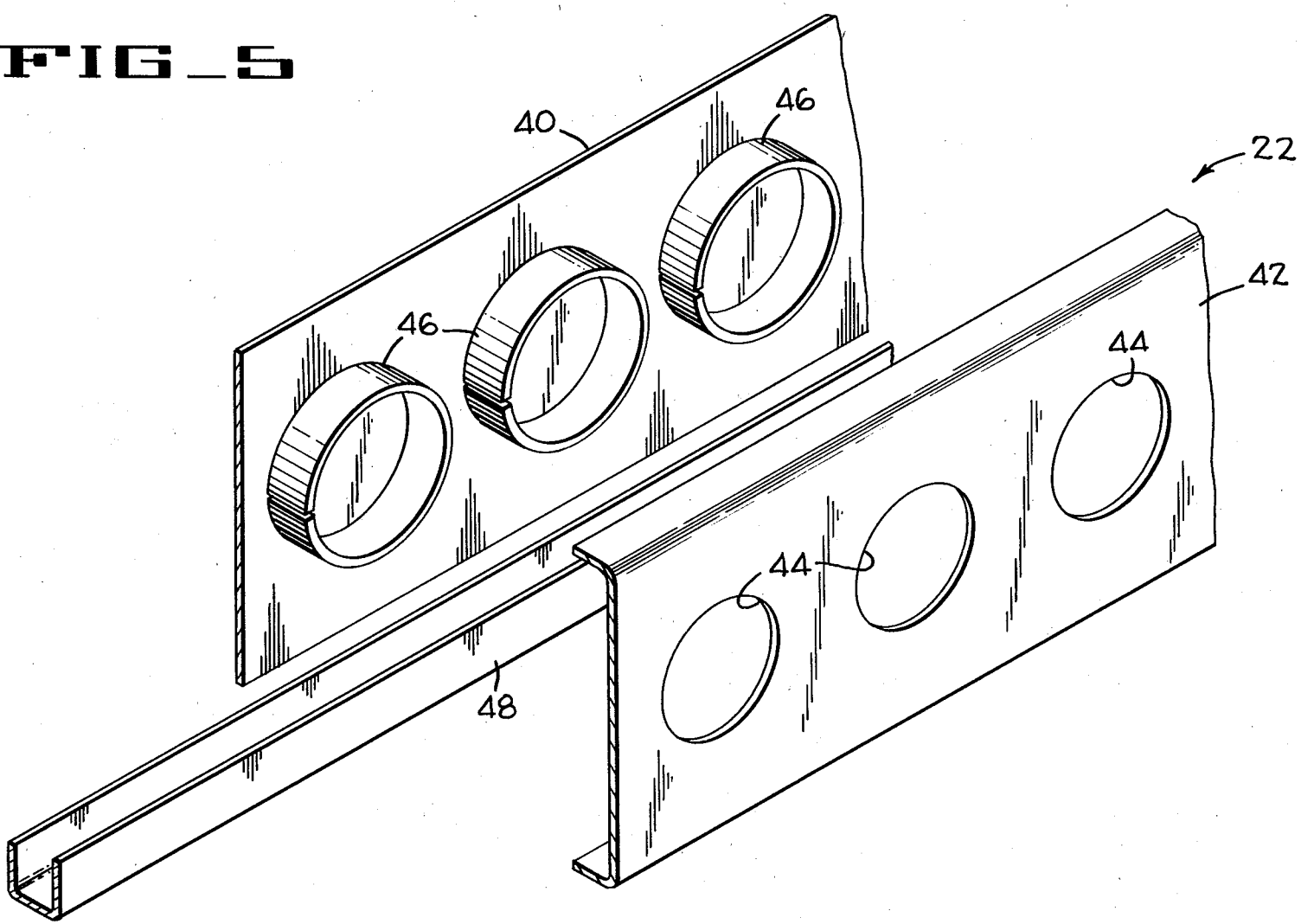
FIG. 5 is an exploded perspective of a fragment of one of the side sills illustrating the tubes welded to the outer side plate and an inner channel portion with evenly spaced holes therein.

An important feature of the invention is that each side sill 22 (FIGS. 2, 4 and 5) comprises an outer plate 40 and an inner plate bent into the shape of a channel 42. The channel 42 has a plurality of evenly spaced large holes 44 cut therein. A plurality of short cylindrical tubes 46 are first welded to the outer plate 40 at evenly spaced intervals, and thereafter the channel 42 is welded to the plate 40 and to the other ends of the tubes 46 which are welded adjacent to the peripheries of the associated holes 44 as best shown in FIG. 4. An elongated channel 48 is then welded to the lower portion of the side sill 22. The outer plate 40 is preferably about 3/16" thick, and the channel 42 and tubes 46 are preferably constructed from ¼" thick steel. The surface area, and accordingly the weight of the tubes are substantially equal to the area and weight of the material removed from the channel 42 to provide the holes 44. Accordingly, each side sill is of box beam construction and is lighter than the side sills of assignee's aforementioned Kaleta application and also has an anti-buckling strength approximately four times greater than the side sills of the type disclosed in the Kaleta application when carrying the same load.

Figure 2:
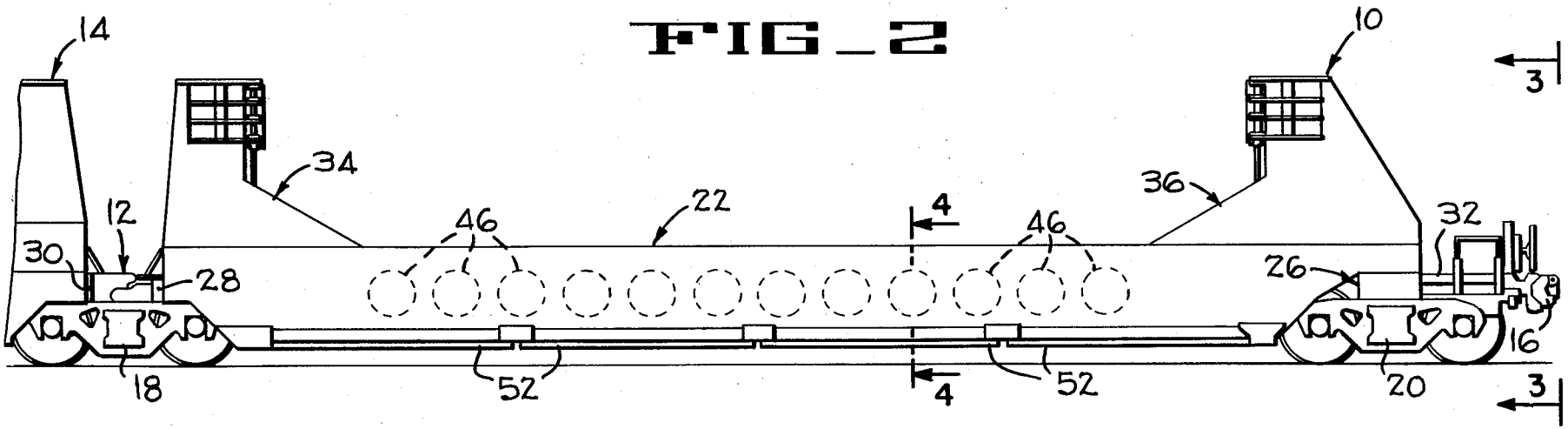
FIG. 2 is a side elevation of FIG. 1.
Figure 3:
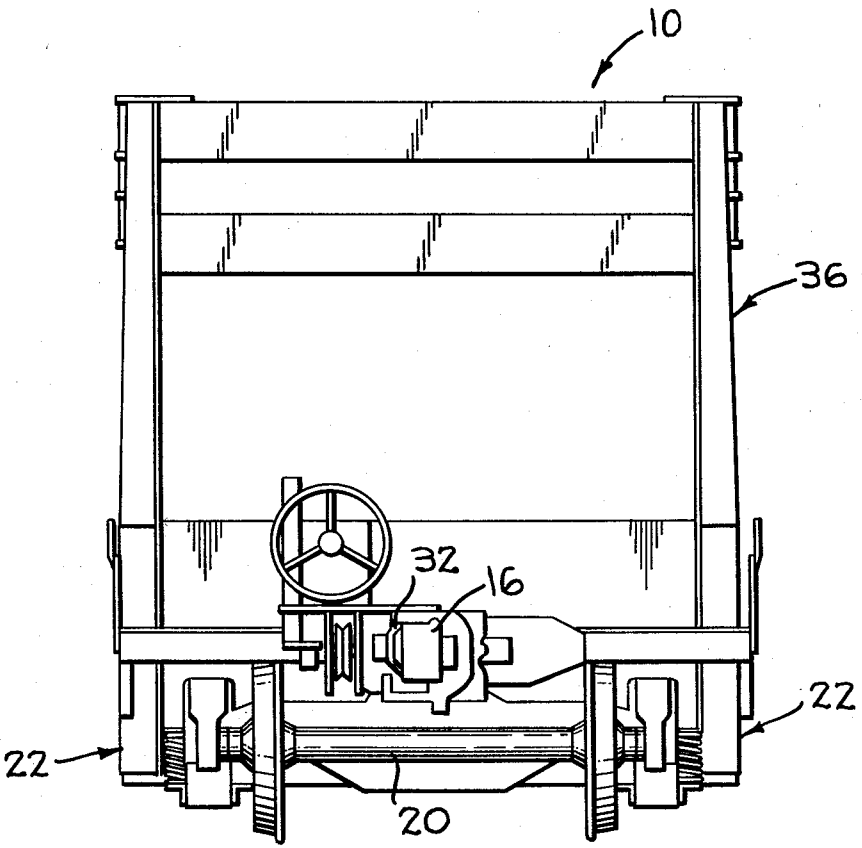
FIG. 3 is an end view of the car looking in the direction of arrows 3—3 of FIG. 2.

As best shown in FIGS. 1 and 2, the lower portion of the two side sills 22 are connected to each other by transverse beams 50 and cross beams 52. The beams 50 and 52 are welded to the side sills, and intermediate portions of the beams 52 are welded to centered pads 54 thereby strengthening the side sills from lateral deflection.

As illustrated in FIG. 1, four corner supporting feet 60 are rigidly secured to the side sills 22 and provide support for the corners of a 40 foot long by 8 foot (or 8½ foot) wide container. The supporting surfaces of the feet are at an elevation slightly above the transverse beams 50 and cross beams 52. The corner supporting feet 60 are similar to those of the Kaleta application. If additional details of the corner supporting feet is desired, reference may be had to the Kaleta application. In addition to the corner supporting feet 60, a pair of central container supporting feet 62 are rigidly secured to the side sills 22 for supporting short containers such as two 20 foot long containers.

As best shown in FIG. 6, each body bolster 24 comprises a pair of transversely extending lower walls 70, an inner wall 72, a top wall 74, a pair of side walls 76, 78 which extend longitudinally of the railway car and a plurality of strengthening baffles 80 having large openings 90 therein for reducing the weight of the body bolster. All of the above parts are welded together as shown in FIG. 6. These components are also welded to a stub-center sill 28 (or 32) and to bottom plates 70 having downwardly angled inner portions 95, which bottom plates 70 are welded to associated stub-center sills 28 or 32 and to side sills 22. A pair of gusseted V-shaped reinforcing members 96 are welded in alignment with each second from the end baffle 80 and serve as guide means for well known side bearings of the general type disclosed in the Kaleta application. Also, a pair of angle brackets 98 (only one being shown) are welded between the associated stub-center sills 28 (or 32) and the associated bottom plate 70 to minimize bending of the body bolster 24 relative to the stub-center sill 28.

FIGS. 7 and 8 illustrate angle stiffening members 100 for stiffening the side sills 22 adjacent their point of connection to the associated body bolsters 24 (or 26).

It will be appreciated that the car 10 defined above cannot have a center sill because the lower surface of the container must be positioned close to the tracks below the level of the center sill. The width of the space available for a car side sill is limited by the container width, either 8 feet or 8½ feet, thus defining the inner dimension of the side sills while the outer dimension is determined by the requisite clearance line of the car. The maximum side sill height is determined by conventional side loading equipment for loading the container into the car. All of these above mentioned factors serve to produce a very small envelope into which a side sill must fit and be of adequate strength. To gain strength to resist vertical bending loads, the sides are made as deep as possible; and to resist warping and buckling, a closed section is most efficient. As a closed section for a given weight, the thickness of its members must decrease; and as the thickness decreases local warping of the thin members become a problem.

Within the above parameters applicant has determined that the use of stiffening rings or tubes 46 most effectively prevent local warping and also contribute to section strength to resist bending and torsion. Even though holes are introduced in the web material, the tubes added in this area put back more strength into the member than would occur if the material had not been removed to provide the holes. The big advantage of using the rings or tubes 46 is that the tubes allow the use of their material to build a deep, strong side sill with vertical load capabilities, able to resist local warping and buckling with a large torsional rigidity. Torsional rigidity is important as the side sills are connected at the bottoms of the sides only by a truss type framework.

Although the best mode contemplated for carrying out the present invention has been herein shown and described, it will be apparent that modification and variation may be made without departing from what is regarded to be the subject matter of the invention.

What is claimed is:

1. An improved body for a light weight railway car having side sills connected to body bolsters pivotally supported on trucks and adapted to support at least one container having a lower portion projecting downwardly between the side sills and body bolsters, the improvement in each side sill and body bolster comprising:

an outer plate of each side sill being formed from thin metal;

a plurality of spaced tubes welded to said outer plate and projecting inwardly therefrom;

means defining a channel having a plurality of portions removed therefrom defining openings therein spaced a distance apart equal to the spacing of said tubes and having said tubes welded adjacent the periphery of said openings, said portions removed from said channel having a weight substantially equal to the weight of said tubes for reducing the weight of said railway car and for improving the anti-buckling strength of said side sills;

each body bolster including a stub-center sill;

a pair of floor plates welded to said stub-center sill and projecting outwardly in opposite directions therefrom;

a pair of upright side walls welded to the ends of said floor plates;

a plurality of spaced upstanding baffles welded to said floor plates and each having a large weight reducing opening therein;

first and second upstanding walls and a top wall welded to each other and to said end walls, said baffles and said floor plates providing a rigid, light weight box body bolster;

a pair of gusseted V-shaped side bearing support members welded to one of said upstanding walls in alignment with associated baffles near the end portions of said body bolster;

a pair of angle brackets welded between the stub-center sill and the associated bottom plate to minimize bending of the bolster relative to its stub-center sill; and means for rigidly connecting associated ends of said side sills to associated ends of said bolsters.

2. An apparatus according to claim 1 wherein the area of said removed portions of said channel is equal to the area of said tubes.

3. An apparatus according to claim 1 wherein said outer plate, said tubes and said inner channel are formed from steel which is less than about ¼" thick.

4. An apparatus according to claim 1 and additionally comprising a plurality of container supporting feet secured to the lower portions of said side sills and adapted to engage and support a container by four lower corners thereof with the lower surface of the container being at a level substantially even with the lower surface of said side sill.

5. An improved body for a lightweight railway car having side sills connected to body bolsters pivotally supported on trucks and adapted to support at least one container having a lower portion projecting downwardly between the side sills, improvements in said side sills comprising:

(a) a first plate formed from sheet metal;

(b) a plurality of equally spaced tubes welded to said first plate and projecting inwardly therefrom;

(c) means defining a first channel having a plurality of portions removed therefrom defining openings therein spaced a distance apart equal to the spacing of said tubes and having said tubes welded adjacent to the peripheries of said openings, said portions removed from said first channel having a weight substantially equal to the weight of said tubes for reducing the weight of said railway car and for improving the anti-buckling strength of said sills;

(d) a plurality of container supporting feet secured to the lower portions of said side sills and having container supporting surfaces and being adapted to engage and support a container by engaging four lower corners thereof with the lower surface of the container being at a level substantially even with the lower surface of said side sills;

(e) said side sills having lower portions and said lower portions being connected together by transverse beams and cross beams at a level below the container supporting surfaces of said container supporting feet; and (f) a second elongated channel being welded to the lower portion of said first plate and said first channel of each side sill for providing a reinforced area to which said transverse beams, cross beams, and said feet are rigidly secured.

* * * * *